US009194635B1

(12) United States Patent
Gibbens et al.

(10) Patent No.: US 9,194,635 B1
(45) Date of Patent: Nov. 24, 2015

(54) WEAPON CONVERSION KIT

(71) Applicants: Kevin W. Gibbens, Mesa, AZ (US); David W. Gibbens, Mesa, AZ (US)

(72) Inventors: Kevin W. Gibbens, Mesa, AZ (US); David W. Gibbens, Mesa, AZ (US)

( * ) Notice: Subject to any disclaimer, the term of this patent is extended or adjusted under 35 U.S.C. 154(b) by 0 days.

(21) Appl. No.: 14/040,657

(22) Filed: Sep. 28, 2013

Related U.S. Application Data

(60) Provisional application No. 61/707,951, filed on Sep. 29, 2012.

(51) Int. Cl.

| | |
|---|---|
| ***F41A 3/00*** | (2006.01) |
| ***F41A 3/12*** | (2006.01) |
| ***F41A 9/70*** | (2006.01) |
| ***F41A 3/66*** | (2006.01) |
| ***F41A 3/72*** | (2006.01) |

(52) U.S. Cl.
CPC ... *F41A 3/12* (2013.01); *F41A 3/66* (2013.01); *F41A 3/72* (2013.01); *F41A 9/70* (2013.01)

(58) Field of Classification Search
CPC ..... F41A 3/12; F41A 3/66; F41A 3/72; F41A 9/70
See application file for complete search history.

(56) References Cited

U.S. PATENT DOCUMENTS

| | | | | |
|---|---|---|---|---|
| 6,070,352 | A * | 6/2000 | Daigle | F41A 11/02 42/49.02 |
| 2007/0199435 | A1* | 8/2007 | Hochstrate | F41A 3/66 89/191.02 |

* cited by examiner

*Primary Examiner* — Samir Abdosh
(74) *Attorney, Agent, or Firm* — Schmeiser, Olsen & Watts LLP

(57) ABSTRACT

A conversion kit for converting an AR-15 rifle to shoot 9 mm rounds is provided. The kit comprises an upper receiver; a weighted bolt carrier operatively coupled within the upper receiver; a bolt coupled in a fixed position within the bolt carrier; and a spring biased firing pin, operatively coupled within the bolt. The weighted bolt carrier is weighted at a rear end of the bolt carrier. The bolt is coupled within the bolt carrier by use of a bolt key, wherein the bolt key and the weighted bolt carrier convert the rifle to a blowback system. The kit further comprises a magazine that comprises and outer case, an insert, a follower and a spring. The outer case of the magazine is a .223 in. outer case. Further still, the follower slides within a compartment defined on three sides by the outer case and the insert on the fourth side.

20 Claims, 5 Drawing Sheets

10
20
26
22
24
15
28
14
12
17
13
16
18

WEAPON CONVERSION KIT

CROSS REFERENCE TO RELATED APPLICATION[S]

This application claims priority to U.S. Provisional Patent Application entitled "WEAPON CONVERSION KIT," Ser. No. 61/707,951, filed Sep. 29, 2012, the disclosure of which is hereby incorporated entirely herein by reference.

BACKGROUND OF THE INVENTION

1. Technical Field

This invention relates generally to a conversion kit for an AR-15 rifle and more particularly to conversion kit to convert an AR-15 rifle to fire 9 mm ammunition.

2. State of the Art

Currently, weapons are used for a variety of reasons from recreational use, to hunting and for tactical use by law enforcement and the like. In particular, rifles are a commonly owned weapon and used for various reasons. A rifle, such as an AR-15, has a specific type of ammunition. The AR-15 fires rounds with a caliber of .223 inches. There is no opportunity to fire a different caliber of round from AR-15 without modifying the rifle. Conventional attempts require several different components and difficult modifications that is not user friendly. Further, conventional conversion kits utilize the standard magazine for the round that it is converting to. For example, conversion to a 9 mm caliber round would then require a magazine that looks like a conventional 9 mm magazine.

Accordingly, there is a need for a conversion kit for a weapon to convert the weapon to shoot a different caliber of round that is easy to install and aesthetically pleasing.

SUMMARY OF THE INVENTION

The present invention relates to a conversion kit to convert an AR-15 rifle to shoot 9 mm caliber rounds.

According to an embodiment, a conversion kit for converting an AR-15 rifle to shoot 9 mm rounds is provided. The kit comprises a weighted bolt carrier; a bolt coupled in a fixed position within the bolt carrier by use of a bolt key, wherein the bolt key and the weighted bolt carrier convert the rifle to a blowback system; and a spring biased firing pin, operatively coupled within the bolt.

Another embodiment includes a conversion kit for converting an AR-15 rifle to shoot 9 mm rounds. The kit comprises a weighted bolt carrier operatively coupled within an upper receiver; a bolt coupled in a fixed position within the bolt carrier, the bolt comprising lugs, wherein the lugs mesh with corresponding lugs of a barrel of the AR-15; and a spring biased firing pin, operatively coupled within the bolt, wherein during operation, the lugs of the bolt do not rotate and lock behind the lugs of the barrel as the lugs do with a gas operated AR-15.

Yet another embodiment includes an AR-15 weapon with a conversion kit for converting the AR-15 rifle to shoot 9 mm rounds. The weapon comprises a lower receiver; an upper receiver comprising a barrel and hand guard; a weighted bolt carrier operatively coupled within the upper receiver, wherein the weighted bolt carrier is weighted at a rear end of the bolt carrier; a bolt coupled in a fixed position within the bolt carrier, the bolt comprising lugs, wherein the lugs mesh with corresponding lugs of a barrel of the AR-15, wherein during operation, the lugs of the bolt do not rotate and lock behind the lugs of the barrel as the lugs do with a gas operated AR-15; a spring biased firing pin, operatively coupled within the bolt; and a magazine comprising an outer case, an insert, a follower and a spring, wherein the outer case is a .223 in. outer case The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a conversion kit to convert an AR-15 rifle to shoot 9 mm caliber rounds.

Figure 1:
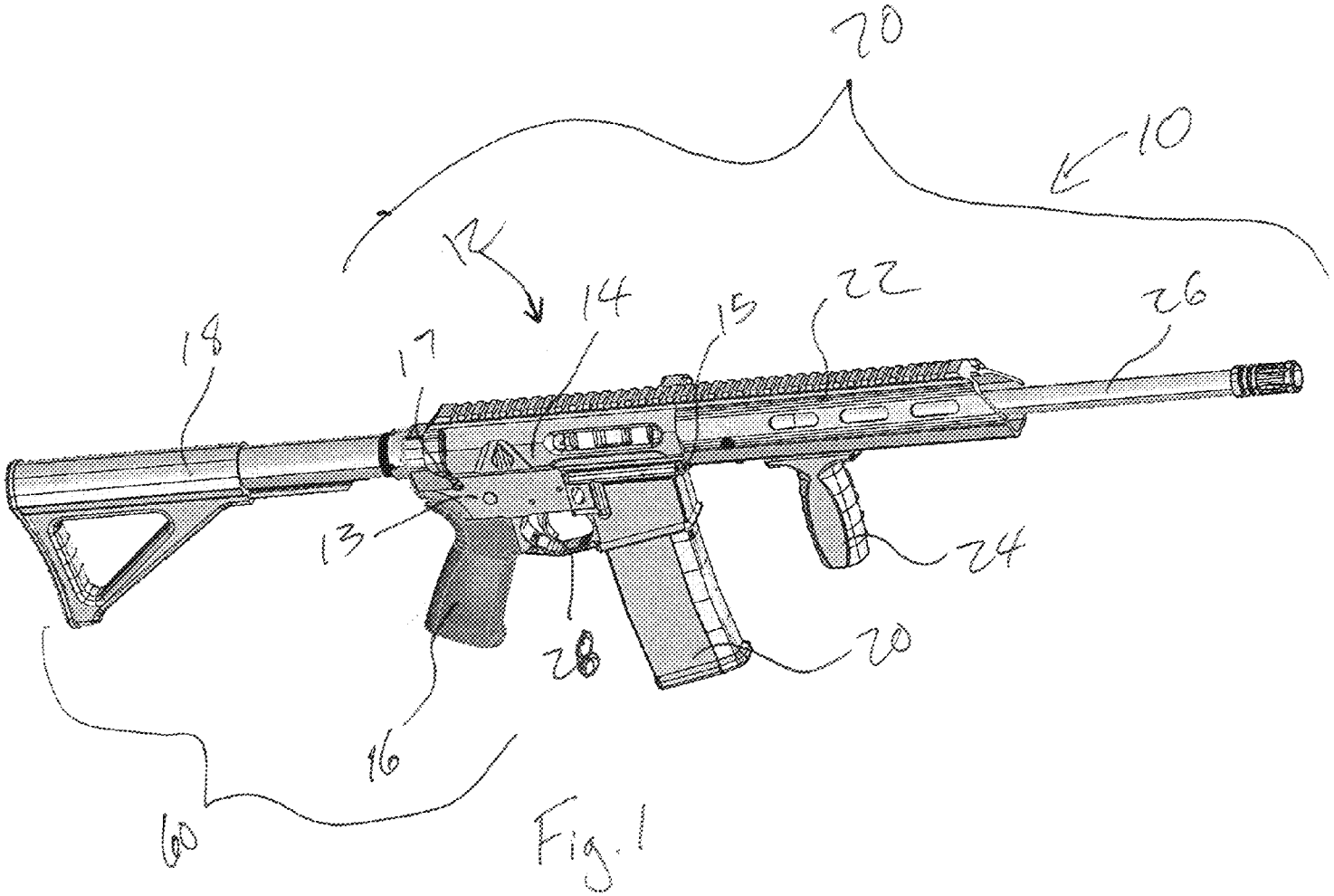
FIG. 1 is a is a perspective view of a rifle with a conversion kit operatively coupled thereto.
Figure 2:
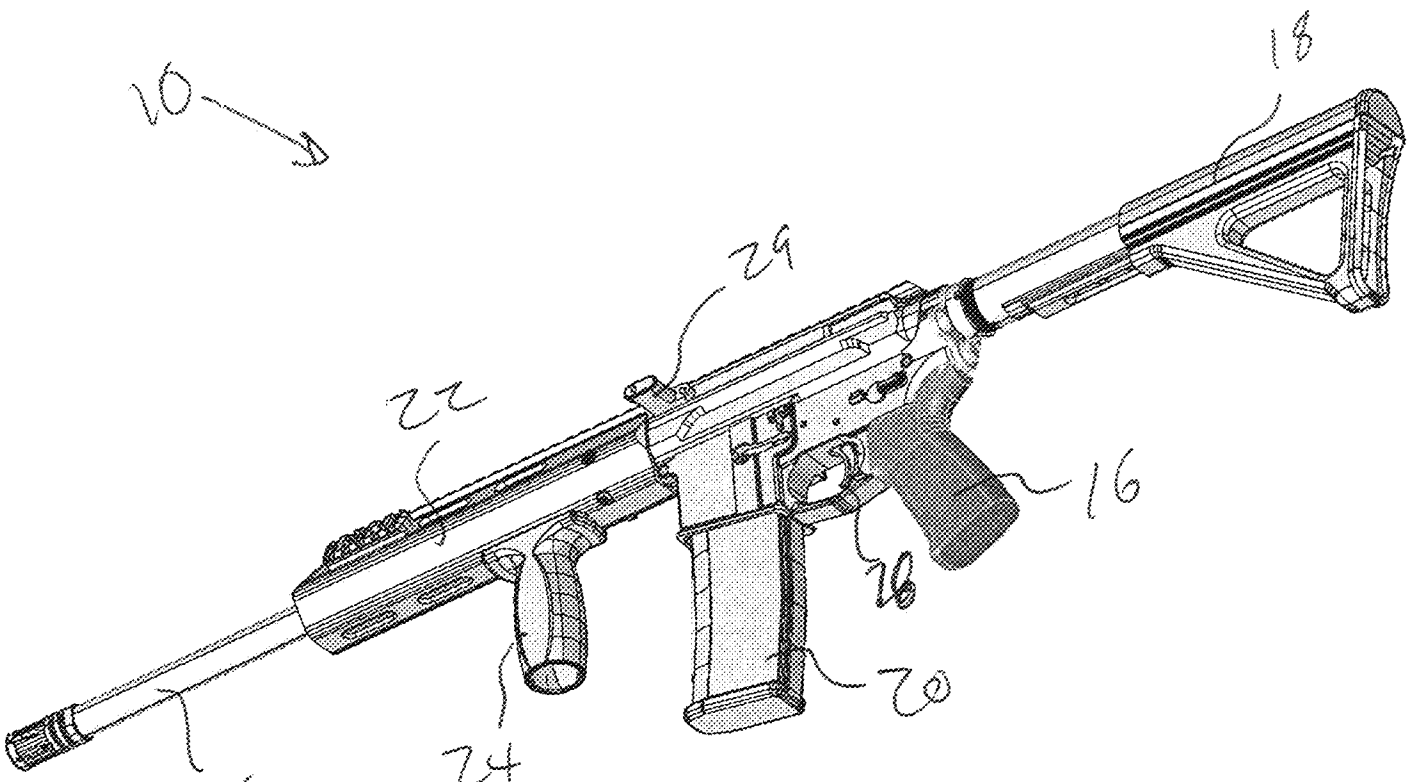
FIG. 2 is another perspective view of a rifle with a conversion kit operatively coupled thereto.
Figure 3:
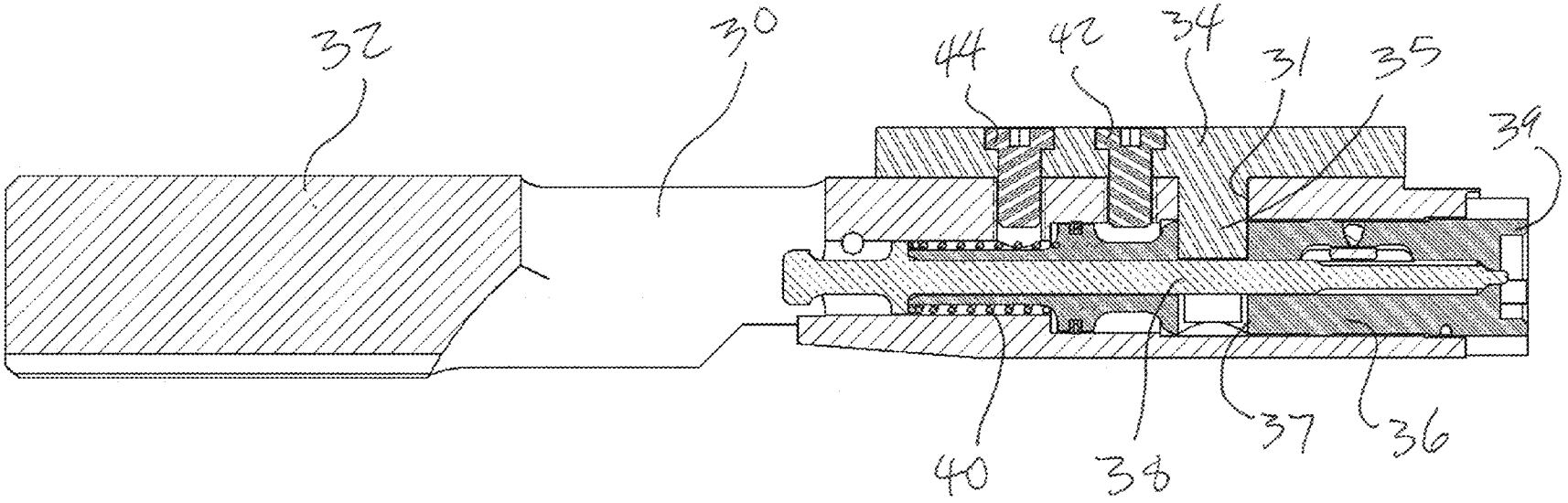
FIG. 3 is a section of a bolt with bolt carrier of a conversion kit.

Referring to the drawings, FIGS. 1 and 3 depict a rifle 10 with the conversion kit 12 coupled there to. The rifle 10 comprises a lower receiver 13, wherein the lower receiver is coupled to a pistol grip 16, a butt stock 18, a trigger 28 a magazine 20 and all other components that are conventionally part of an AR-15 rifle. The rifle 10 further comprises an upper receiver 14, wherein the upper receiver is coupled to a barrel 26, a hand guard 22 and an optional second pistol grip 24. A bolt carrier and bolt are operationally coupled within the upper receiver 14. According to embodiments of the present invention, the lower receiver 13 is operatively coupled with the upper receiver 14 by use of two pins, wherein the two pins comprise a front pin 15 and a rear pin 17.

Operationally, the coupling of the lower receiver 13 to the upper receiver 14 results in a mechanical coupling of all of the interior operational components located within the lower receiver and the bolt 30 of the upper receiver 14. The conversion kit 12 may comprise the upper receiver 14, bolt carrier 30 with bolt 36, barrel 26, hand guard 22 and magazine 20. All of the components of the conversion kit, with the exception of the magazine 20, are operationally assembled together. In the assembled configuration, the upper receiver 14 may the conversion kit 12 may be coupled to the lower receiver 13 by use of front pin 15 and rear pin 17. In this way, the conversion kit 12 is a two pin conversion kit.

Further, the conversion kit, in accordance with some embodiments, may also include a side charging handle 29, wherein the side charging handle 29 extends out of a side of the upper receiver 14 as opposed to from a rear portion of the upper receiver 14.

It will be understood that a lower 60 of the rifle 10 includes the lower receiver 13, the butt stock 18, the trigger 28 and all internal components conventionally assembled in an AR-15, as shown in Appendix A. Appendix A is hereby incorporated entirely herein by reference. The upper 70 of the rifle 10 includes the upper receiver 14 with the bolt carrier 30 and associated components, the hand guard 22 and the barrel 26, including other conventional parts as shown in Appendix A that are not specifically called out in FIGS. 1-5. In this way, the conversion kit 12 may fully replace an upper of an AR-15 and easily be switched back because of the two pin conversion.

Referring further to the drawings, FIG. 3, the conversion kit 12 comprises a bolt carrier 30, wherein the bolt carrier 30 is a weighted bolt carrier. The rear end 32 of the bolt carrier 30 is solid material and weighted. The purpose for weighting the rear end 32 of the bolt carrier is that in order to convert the rifle 10 to a shoot 9 mm caliber rounds, the bolt carrier 30 must replace components and change the weapon to a blowback system as opposed to a gas operated system. The weight at the rear end 32 of the bolt carrier provides the necessary balance of the rile 10 to allow the blowback system to operate correctly. The bolt carrier 30 carries the bolt 36. The blot 36 is coupled within the bolt carrier 30 and is fixed within the bolt carrier 30 by use of bolt key 34, wherein the bolt key 34 comprises protrusion 35 that extends within aperture 31 and engages channel 37 of the bolt 36. The bolt key 34 is coupled to the bolt carrier 30 by use of bolt key screws 42 and 44.

It will be understood that the bolt 36 can be a modified .223 in. caliber bolt. This allows the conversion kit to use the same barrel extension as a .223 in. barrel. The bolt 36 comprises lugs 39, wherein the lugs 39 mesh with corresponding lugs (not shown) of the barrel 26. However, with the conversion kit 12, the lugs 39 of the bolt 36 do not rotate and lock behind the lugs of the barrel 26 as they do with the gas operated AR-15.

Additionally, the firing pin 38 is operatively coupled within the bolt 36 and the bolt carrier 30. Conventional firing pins of AR-15 are floating pins, however, a conversion to a 9 mm round includes certain risks when having a free floating pin, such as, but not limited to accidental discharge of the round if the firing pin floats and strikes a bullet primer. This is particularly a risk in smaller rounds, such as a 9 mm. Therefore, the conversion kit 12 includes a firing pin 38 that is biased away from the front end of the bolt 36 by use of a firing pin spring 40.

Figure 4:
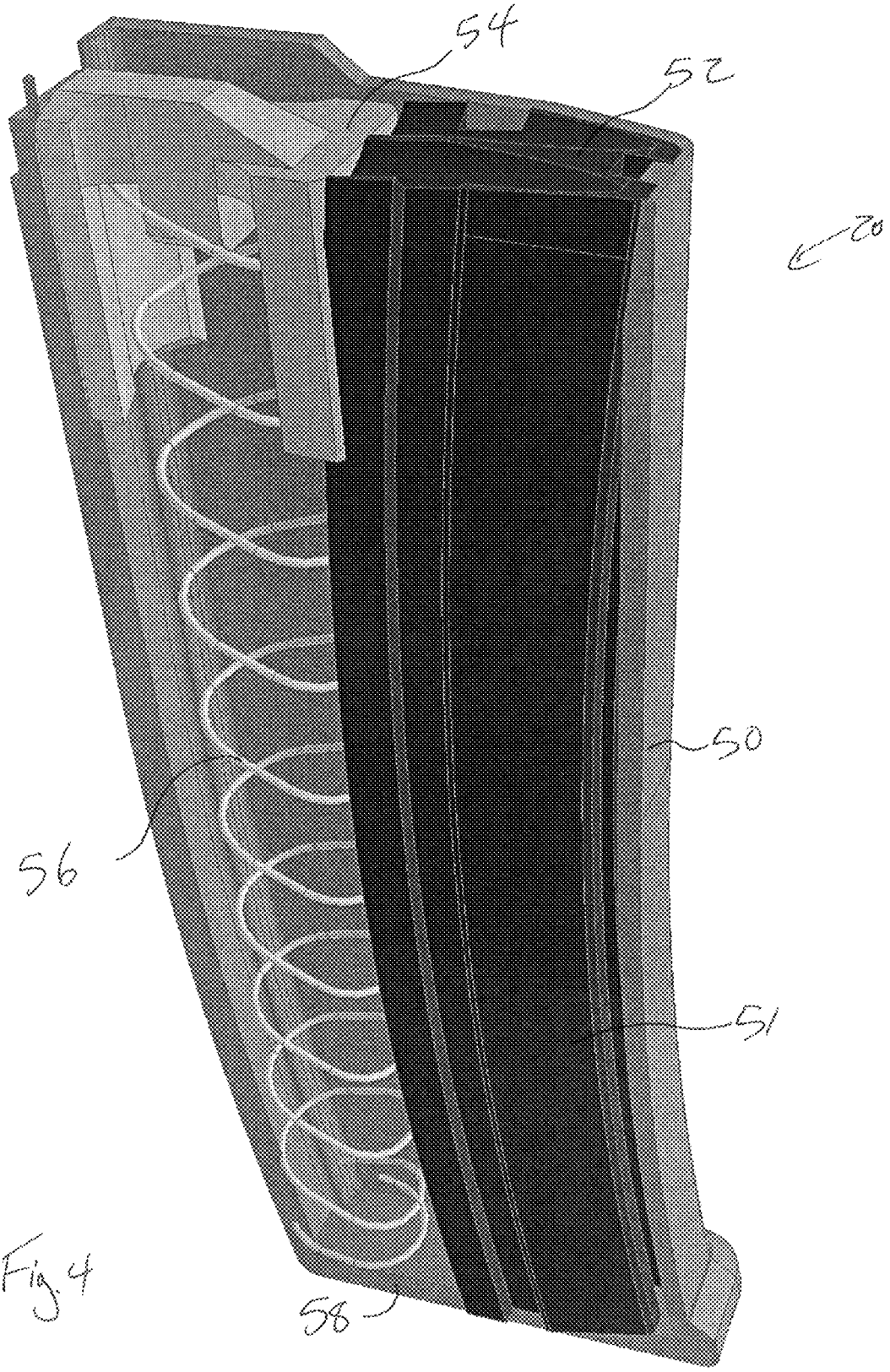
FIG. 4 is a perspective view of a magazine of a conversion kit.
Figure 5:
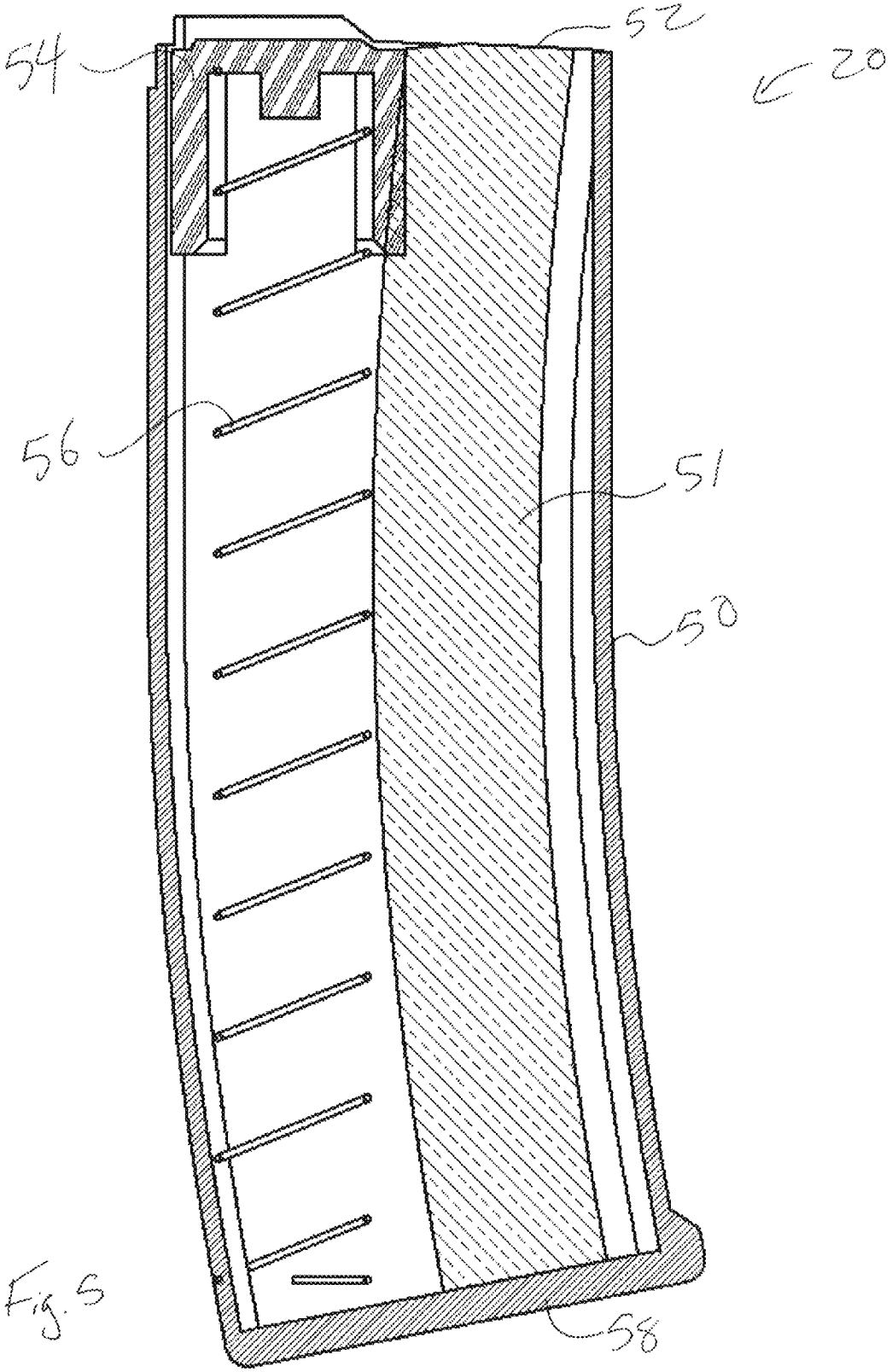
FIG. 5 is side section view of a magazine of a conversion kit.

The conversion kit 12 may further comprise a magazine 20 as shown in FIGS. 4 and 5. The magazine 20 includes an outer case 50, an insert 51, a follower 54 and a spring 56. The top of the insert 51 comprises an inclined surface 52 that serves as a type of ramp feature to assist in feeding the round into the chamber. The inclined surface 52 may also have a channel extending along the surface 52 to ensure that the round is properly aligned during feeding.

Follower 54 is biased toward a top of the magazine by the spring 56, wherein the follower 54 is slides within a compartment defined on three sides by the outer case 50 and the insert 51 on the forth side. The insert 51 serves to ensure the 9 mm rounds align properly on the follower 54. The bottom of the magazine 20 comprises a floor plate 58 that is removably coupled to the bottom side of the outer case 50. The floor plate 58 engages an opposing end of the spring 56, and serves as a stationary surface with respect to the outer case 50 to push the follower away from the floor plate 58. On a top side of the magazine includes a round retainer (not shown) to prevent the round from falling out of the magazine 20 and directing the round to be slid from the magazine and up the inclined surface 52 in order to place the round in an firing position.

The insert 51 with the follower 54 and the spring 56 allows for 9 mm rounds to be loaded within a magazine for .223 in. rounds and provides an aesthetically pleasing weapon wherein the observer does not know from looking at the rifle 10 that smaller rounds are loaded.

The rifle 10 with the conversion kit 12 allows for the weapon to shoot 9 mm rounds and therefore the sound of the rifle 10 when firing is reduced. This is particularly helpful in tactical situations where the ability to properly hear is vital. The discharge of the rifle 10 with the smaller round results in a reduced sound and reduces the opportunity of impairing the hearing of the operator of the weapon. This is different from the conventional .223 in. rounds, wherein ear plugs are often worn to shoot and particularly in enclosed areas, the firing of the weapon results in difficulty of hearing.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A conversion kit for converting an AR-15 rifle to shoot 9 mm rounds, the kit comprising:

a weighted bolt carrier;

a bolt coupled in a fixed position within the bolt carrier by use of a bolt key, wherein the bolt key and the weighted bolt carrier convert the rifle to a blowback system; and a spring biased firing pin, operatively coupled within the bolt.

2. The kit of claim 1, wherein the weighted bolt carrier is weighted at a rear end of the bolt carrier.

3. The kit of claim 1, further comprising a magazine, wherein the magazine comprises and outer case, an insert, a follower and a spring.

4. The kit of claim 3, wherein the outer case of the magazine is a .223 in. outer case.

5. The kit of claim 3, wherein the follower slides within a compartment defined on three sides by the outer case and the insert on the forth side.

6. The kit of claim 5, wherein follower allows for a plurality of 9 mm rounds to be loaded within the magazine.

7. The kit of claim 6, wherein the insert comprises a top surface having an incline.

8. The kit of claim 7, wherein the inclined top surface of the insert assist in the feeding of the round into the chamber.

9. The kit of claim 1, further comprising a side charging handle.

10. The kit of claim 1, further comprising a conventional lower receiver.

11. The kit of claim 10, wherein the conversion kit is coupled to a barrel and hand guard to form an upper receiver.

12. The kit of claim 11, wherein the upper receiver with the conversion kit is coupled to the conventional lower by use of a front pin and a rear pin.

13. A conversion kit for converting an AR-15 rifle to shoot 9 mm rounds, the kit comprising:

a weighted bolt carrier operatively coupled within an upper receiver;

a bolt coupled in a fixed position within the bolt carrier, the bolt comprising lugs, wherein the lugs mesh with corresponding lugs of a barrel of the AR-15; and a spring biased firing pin, operatively coupled within the bolt, wherein during operation, the lugs of the bolt do not rotate and lock behind the lugs of the barrel as the lugs do with a gas operated AR-15.

14. The kit of claim 1, wherein the weighted bolt carrier is weighted at a rear end of the bolt carrier.

15. The kit of claim 1, further comprising a magazine, wherein the magazine comprises and outer case, an insert, a follower and a spring.

16. The kit of claim 4, wherein the outer case of the magazine is a .223 in. outer case.

17. The kit of claim 11, wherein the conversion kit is coupled to a barrel and hand guard to form an upper receiver.

18. The kit of claim 12, wherein the upper receiver with the conversion kit is coupled to a conventional lower receiver by use of a front pin and a rear pin.

19. An AR-15 weapon with a conversion kit for converting the AR-15 rifle to shoot 9 mm rounds, the weapon comprising:

a lower receiver;

an upper receiver comprising a barrel and hand guard;

a weighted bolt carrier operatively coupled within the upper receiver, wherein the weighted bolt carrier is weighted at a rear end of the bolt carrier;

a bolt coupled in a fixed position within the bolt carrier, the bolt comprising lugs, wherein the lugs mesh with corresponding lugs of a barrel of the AR-15, wherein during operation, the lugs of the bolt do not rotate and lock behind the lugs of the barrel as the lugs do with a gas operated AR-15;

a spring biased firing pin, operatively coupled within the bolt; and a magazine comprising an outer case, an insert, a follower and a spring, wherein the outer case is a .223 in. outer case.

20. The weapon of claim 19, wherein the upper receiver with the conversion kit is coupled to the lower receiver by use of a front pin and a rear pin.

* * * * *